US005543895A

United States Patent [19]

Katsuhara

[11] Patent Number: 5,543,895

[45] Date of Patent: Aug. 6, 1996

[54] METHOD OF ADJUSTING DENSITY DETECTING DEVICE USED FOR IMAGE FORMING APPARATUS

[75] Inventor: Kenji Katsuhara, Osaka, Japan

[73] Assignee: Mita Industrial Co., Ltd., Osaka, Japan

[21] Appl. No.: 517,551

[22] Filed: Aug. 21, 1995

[30] Foreign Application Priority Data

Sep. 20, 1994 [JP] Japan ..... 6-225179

[51] Int. Cl.[6] ..... G03G 15/00

[52] U.S. Cl. ..... 355/203; 356/445; 355/246

[58] Field of Search ..... 355/208, 246; 356/445, 446

[56] References Cited

U.S. PATENT DOCUMENTS

| | | | |
|---|---|---|---|
| 4,878,082 | 10/1989 | Matsushita et al. | 355/208 |
| 5,245,390 | 9/1993 | Ishigaki et al. | 355/246 |
| 5,477,312 | 12/1995 | Hori | 355/208 |

*Primary Examiner*—Joan H. Pendegrass
*Assistant Examiner*—Quana Grainger
*Attorney, Agent, or Firm*—Beveridge, DeGrandi Weilacher & Young LLP

[57] ABSTRACT

A method and an apparatus for setting an amount of light to be irradiated onto a photoreceptor from a density detecting device precisely in a short time in detecting the density of a toner image on the photoreceptor. Light of amounts in a plurality of steps is successively irradiated onto one point of the photoreceptor on which no toner adheres. Density data outputted by the density detecting device which correspond to the amounts of light in the respective steps are acquired. One density data is selected on a predetermined basis out of a plurality of density data acquired. Light of the amount in the step corresponding to the selected one density data (a reference amount of light) is irradiated onto a plurality of points of the photoreceptor. The density data outputted by the density detecting device at each of the points is acquired. The average value of the acquired density data corresponding to the plurality of points is found as average density data. Further, a plurality of acquired density data corresponding to the amounts of light in the plurality of steps are corrected on the basis of the average density data and the selected one density data. The amount of light for detecting a toner image density is set on the basis of the plurality of density data corrected.

18 Claims, 8 Drawing Sheets

METHOD OF ADJUSTING DENSITY DETECTING DEVICE USED FOR IMAGE FORMING APPARATUS

BACKGROUND OF THE INVENTION

1. Field of the Invention

The present invention relates to a method and an apparatus for adjusting a density detecting device, which device is used for an image forming apparatus for forming an image by an electrophotographic process, for example, an electrostatic copying machine, and which device is for outputting density data utilized in adjusting the image forming conditions such as the amount of charge, the amount of exposure and the developing bias so as to keep the formed image high in quality.

2. Description of the Related Art

In the electrostatic copying machine, a copy image is formed in the following manner. Specifically, a real original which is put on a transparent platen to reproduce the image thereof is illuminated and scanned. Reflected light from the real original is introduced into a photosensitive drum which is rotated in synchronization with the illumination and scanning. As a result, the photosensitive drum is exposed. The surface of the photosensitive drum before the exposure is uniformly charged by a charger. An electrostatic latent image corresponding to the real original is formed on the surface of the photosensitive drum by selective charge elimination caused by the exposure.

The formed electrostatic latent image is developed into a toner image by a developing device to which toner is supplied from a toner hopper. The toner image is transferred onto copy paper by corona discharges in a transferring corona discharger. The copy paper on which the toner image has been transferred is introduced into a fixing device, where the toner is fixed to the copy paper, thereby completing copying.

An attempt to stably obtain an image high in quality in the above described electrostatic copying machine brings about the necessity of suitably adjusting the image forming conditions such as the amount of exposure and the amount of charge of the photosensitive drum, the developing bias and the amount of toner to be supplied to the developing device.

The image forming conditions are adjusted for each predetermined period, for example, at the time of maintenance. In adjusting the image forming conditions, a pure white or solid black pseudo original (a reference density original) which is arranged in a region other than a region where the real original is illuminated and scanned is experimentally illuminated, and a toner image corresponding to the pseudo original is formed. At this time, the amount of exposure, the surface potential, the density of the toner image on the surface of the photosensitive drum, and the like are detected, and the image forming conditions are automatically adjusted on the basis of the results of the detection. Specifically, where the pure white pseudo original is illuminated to form a toner image, if so-called fog is detected on the basis of the detected toner image density, the amount of exposure is increased. On the other hand, where the solid black pseudo original is illuminated to form a toner image, if it is judged that the density is insufficient on the basis of the results of the detection of the toner image density, toner is automatically supplied to the developing device from the toner hopper.

A reflection type photosensor which is constituted by a pair of a light emitting element and a light receiving element arranged opposed to the photosensitive drum is generally applied to the detection of the density of the toner image on the surface of the photosensitive drum. Specifically, light of a previously set amount is irradiated onto the photosensitive drum from the light emitting element, and density data corresponding to the amount of light reflected from the photosensitive drum is outputted from the light receiving element. Since the amount of the reflected light corresponds to the density of the toner image on the surface of the photosensitive drum, it is possible to detect the density of the toner image on the surface of the photosensitive drum on the basis of the above described density data.

At the time of initialization immediately after manufacturing the copying machine, two types of amounts of light to be irradiated, for example, an amount of light for low density and an amount of light for high density are set as amounts of light to be irradiated onto the photosensitive drum from the light emitting element in the reflection type photosensor. The amount of light for low density is the one to be irradiated onto the photosensitive drum from the light emitting element when a fog detection is performed. On the other hand, the amount light to be irradiated for high density is the one to be irradiated when a solid black detection is performed.

The reason why the amount of light to be irradiated is varied depending on a case where fog is detected and a case where a solid black is detected is as follows.

Specifically, when the fog detection is performed, toner hardly adheres to the photosensitive drum because the pseudo original on which a pure white image is formed is illuminated. Consequently, the amount of light received by the light receiving element is relatively high. On the other hand, an output of the light receiving element is saturated if the amount of received light is increased. Therefore, the amount of light to be irradiated when in the fog detection must be relatively decreased so as to restrain the amount of light reflected from the photosensitive drum.

On the other hand, when a solid black detection is performed, a large amount of toner adheres to the photosensitive drum because the pseudo original on which a solid black image is formed is illuminated. Consequently, most of light irradiated from the light emitting element is absorbed by the toner on the surface of the photosensitive drum, whereby the amount of light received by the light receiving element is relatively small. On the other hand, the light receiving element cannot detect a subtle change in the amount of received light if the amount of received light is small. Therefore, the amount of light to be irradiated in the solid black detection must be made relatively large so as to increase the amount of reflected light.

An amount of light for low density to be irradiated in the fog detection is found in the following manner by maximizing the amount of exposure to bring the photosensitive drum into an undeveloped state where no toner adheres on the surface.

Specifically, the photosensitive drum which has not been developed is rotated once, and light of a certain amount is irradiated onto the photosensitive drum from the light emitting element a plurality of times during the rotation thereby to find the average of density data corresponding to the amounts of reflected light outputted from the light receiving element. The photosensitive drum is rotated once in order to restrain the variation caused by irregularities in the circumferential direction on the surface of the photosensitive drum.

The density data are acquired with respect to a plurality of amounts of light to be irradiated in predetermined steps (for example, 100 steps). An amount of light corresponding to the density data selected on a predetermined basis out of the acquired density data corresponding to the amounts of light in the steps is set as an amount of light for low density.

On the other hand, an amount of light for high density to be irradiated in the solid black detection is found by substituting the obtained amount of light for low density in a predetermined conversion equation.

In the above described prior art, however, the density data corresponding to the amounts of light to be irradiated in the plurality of steps are acquired by rotating the photosensitive drum once for each of the amounts of light to be irradiated in the steps. Therefore, a long time is inevitably required to acquire the density data. Moreover, light is irradiated onto the photosensitive drum over a long period of time, thereby causing the early light-induced fatigue of the photosensitive drum.

On the other hand, if the number of steps of the amounts of light to be irradiated from the light emitting element in the reflection type photosensor is increased, the density of the toner image on the surface of the photosensitive drum can be detected with high precision, thereby making it possible to set the amount of light for low density to a very suitable value. If the number of steps of the amounts of light to be irradiated is increased, however, it takes much time to acquire the density data. Therefore, it is impossible to easily increase the number of steps of the amounts of light to be irradiated, and it is not altogether easy to set a suitable amount of light for low density with high precision.

SUMMARY OF THE INVENTION

An object of the present invention is to provide a method of adjusting a density detecting device used for an image forming apparatus capable of acquiring accurate density data required to set an amount of light to be irradiated at the time of density detection in a short time.

Another object of the present invention is to provide a method in which a density detecting device can be satisfactorily adjusted while restraining the light-induced fatigue of a photoreceptor.

Still another object of the present invention is to provide an apparatus for adjusting a density detecting device used for an image forming apparatus capable of acquiring accurate density data required to set an amount of light to be irradiated at the time of density detection in a short time.

A further object of the present invention is to provide an apparatus capable of satisfactorily adjusting a density detecting device while restraining the light-induced fatigue of a photoreceptor.

According to the present invention, light of amounts in a plurality of steps from the maximum amount to the minimum amount is successively irradiated from a density detecting device onto one point of a photoreceptor on which no toner adheres. Density data outputted by the density detecting device which correspond to the amounts of light in the respective steps are acquired. In addition, one density data are selected on a predetermined basis out of the plurality of acquired density data corresponding to the amounts of light in the plurality of steps. Light of the amount in the step corresponding to the selected one density data (a reference amount of light) is irradiated onto a plurality of points of the photoreceptor from the density detecting device. The density data outputted by the density detecting device for each point is acquired. The average value of the acquired density data corresponding to the plurality of points is found as average density data. Further, the plurality of acquired density data corresponding to the amounts of light in the plurality of steps are corrected on the basis of the average density data and the selected one density data. An amount of light to be irradiated onto the photoreceptor from the density detecting device in the density detection of a toner image formed on the photoreceptor is set on the basis of the plurality of density data corrected.

In the present invention, the density data concerning the plurality of points of the photoreceptor are thus acquired only with respect to the reference amount of light corresponding to the selected one density data. Density data concerning only one point of the photoreceptor is acquired with respect to the amounts of light in the remaining steps. Consequently, it is possible to set an amount of light for detecting a toner image density in a short time.

Moreover, the average value of the density data found with respect to the plurality of points of the photoreceptor is found with respect to the reference amount of light. The average value is regarded as a value which has absorbed the effect such as irregularities of the photoreceptor. Each of the density data corresponding to the amounts of light in the remaining steps is corrected on the basis of the average value. The density data after the correction can be regarded as a value which has absorbed the effect such as irregularities of the photoreceptor. An amount of light for detecting a toner image density is set on the basis of the data after the correction, whereby the set amount of light is an accurate value.

Furthermore, light from the density detecting device is irradiated onto the plurality of points of the photoreceptor only with respect to the reference amount of light, whereby the total amount of light received by the photoreceptor in the case of the adjustment is reduced. Therefore, the light-induced fatigue of the photoreceptor can be reduced.

Additionally, even if the number of steps of the amounts of light to be irradiated onto the photoreceptor from the density detecting device is increased, time required for the adjustment is not too long. Consequently, the amount of light for detecting a toner image density can be further suitably set by increasing the number of steps of the amounts of light. Therefore, the toner image density can be detected with high precision.

In correcting the plurality of density data, it is preferable that the density data corresponding to the maximum amount of light is taken into consideration.

More specifically, it is preferable that the correction of the plurality of density data is performed by correcting the density data corresponding to the amount of light in each of the steps on the basis of the difference between the density data corresponding to the maximum amount of light and the average density data, the difference between the density data corresponding to the maximum amount of light and the selected one density data, and the difference between the average density data and the selected one density data. In this case, data $D_S'$ after the correction is more preferably found by operating density data $D_S$ corresponding to the amount of light in each of the steps in accordance with the following equation:

$$D_S' = D_S(D_{SMAX}-D_{SAV})/(D_{SMAX}-D_S1)+D_{SMAX}(D_{SAV}-D_S1)/(D_{SMAX}-D_S1)$$

wherein, $D_{SMAX}$ denotes the density data corresponding to the maximum amount of light, $D_{SAV}$ denotes the average density data, and $D_S1$ denotes the selected one density data.

The surface of the photoreceptor may be movable relative to the density detecting device. In this case, in acquiring the density data outputted by the density detecting device which correspond to the amounts of light in the plurality of steps, the photoreceptor may be held stationary. Further, in acquiring the density data at the plurality of points of the photoreceptor, the surface of the photoreceptor may be moved relative to the density detecting device. It is preferable that light is irradiated onto the photoreceptor which is moving from the density detecting device a plurality of times.

More specifically, the photoreceptor may be in the shape of a cylinder which is rotatable around the axis. In this case, the photoreceptor can be held stationary by stopping the rotation of the photoreceptor, while making it possible to change the relative positional relationship between the surface of the photoreceptor and the density detecting device by rotating the photoreceptor.

The density detecting device may be one for detecting, when a toner image corresponding to pseudo original means carrying an image having a reference density thereon is formed on the photoreceptor, the density of the toner image. In this case, it is preferable that an amount of light for detecting the density of the toner image corresponding to the pseudo original means is set.

The pseudo original means includes a white original for fog detection, for example. In this case, if the density detecting device outputs density data roughly inversely proportional to the amount of light reflected from the photoreceptor, it is preferable that the amount of light in the maximum step is set as an amount of light for a low-density region out of the amounts of light in the steps in which the corrected density data takes a value of not less than a predetermined value.

The pseudo original means may further include a black original for solid black detection. In this case, an amount of light for a high-density region may be set by substituting the amount of light for a low-density region in a predetermined conversion equation.

The foregoing and other objects, features, aspects and advantages of the present invention will become more apparent from the following detailed description of the present invention when taken in conjunction with the accompanying drawings.

DETAILED DESCRIPTION OF THE PREFERRED EMBODIMENTS

Figure 1:
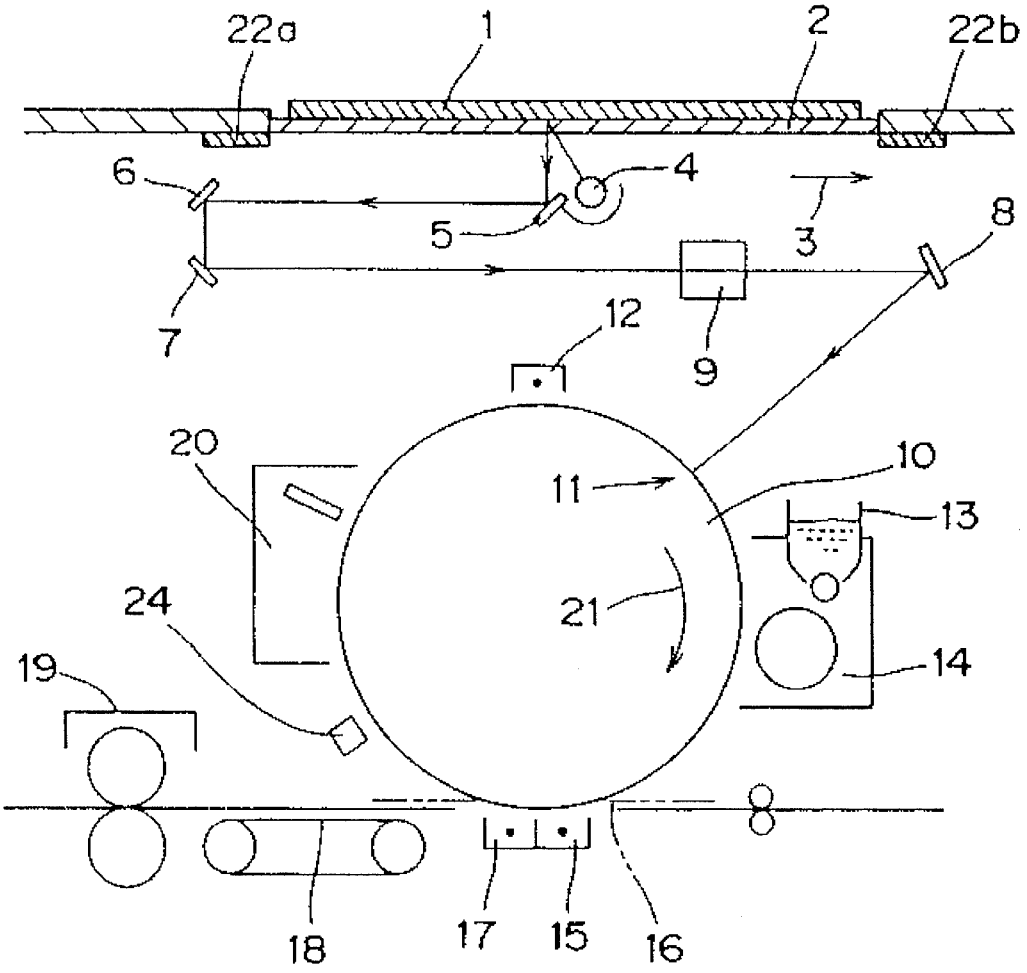
FIG. 1 is a conceptual diagram showing the schematic construction of an electrostatic copying machine having a density detecting device to which an adjusting method according to one embodiment of the present invention is applied.

FIG. 1 is a conceptual diagram showing the schematic construction of an electrostatic copying machine having a density detecting device to which an adjusting method according to one embodiment of the present invention is applied. There is provided, below a transparent platen 2 composed of transparent glass on which a real original 1 is to be put, a light source 4 for illuminating and scanning the surface of the real original 1 put on the transparent platen 2. The light source 4 is composed of a halogen lamp or the like, which is conveyed at predetermined speed in a direction indicated by an arrow 3 at the time of an image forming operation.

Reflected light from the original is introduced into an exposure region 11 on the surface of a photosensitive drum 10 through reflecting mirrors 5, 6, 7 and 8 and a zoom lens 9. On the other hand, the surface of the photosensitive drum 10 before the exposure to the reflected light is uniformly charged by a charging corona discharger 12. As a result, an electrostatic latent image corresponding to the real original 1 is formed on the surface of the photosensitive drum 10.

At the time of the image forming operation, the reflecting mirror 5, along with the light source 4, is conveyed, and the reflecting mirrors 6 and 7 are conveyed in the direction indicated by the arrow 3 at a speed which is half the speed of conveyance of the light source 4. The photosensitive drum 10 is rotated and driven in a direction indicated by an arrow 21 in synchronization with the movement of the light source 4.

The electrostatic latent image formed on the surface of the photosensitive drum 10 is developed into a toner image by a developing device 14 to which toner is supplied from a toner hopper 13. The developed toner image is transferred onto the surface of copy paper 16 in a transferring corona discharger 15. The copy paper 16 on which the toner image is transferred is separated from the photosensitive drum 10 by a separating corona discharger 17, and then is introduced into a fixing device 19 by a conveying belt 18. In the fixing device 19, the toner is fixed by heating on the surface of the copy paper 16, thereby completing copying.

The toner remaining on the surface of the photosensitive drum 10 after the transfer of the toner image is removed by a cleaning device 20, to prepare for the subsequent copying.

Pseudo originals **22*a* and 22*b* which are density reference originals respectively carrying a pure white image and a solid black image are respectively provided on both sides of the transparent platen 2 and inside the main body of the copying machine. The pseudo originals 22*a* and 22*b* are used in adjusting the density of an image to be formed on the copy paper 16**, as described later.

Furthermore, a reflection type photosensor 24 constituting a part of a density detecting device 23 as described below is provided so as to be opposed to the photosensitive drum 10 in a position in the vicinity of the photosensitive drum 10 between the separating corona discharger 17 and the cleaning device 20.

Figure 2:
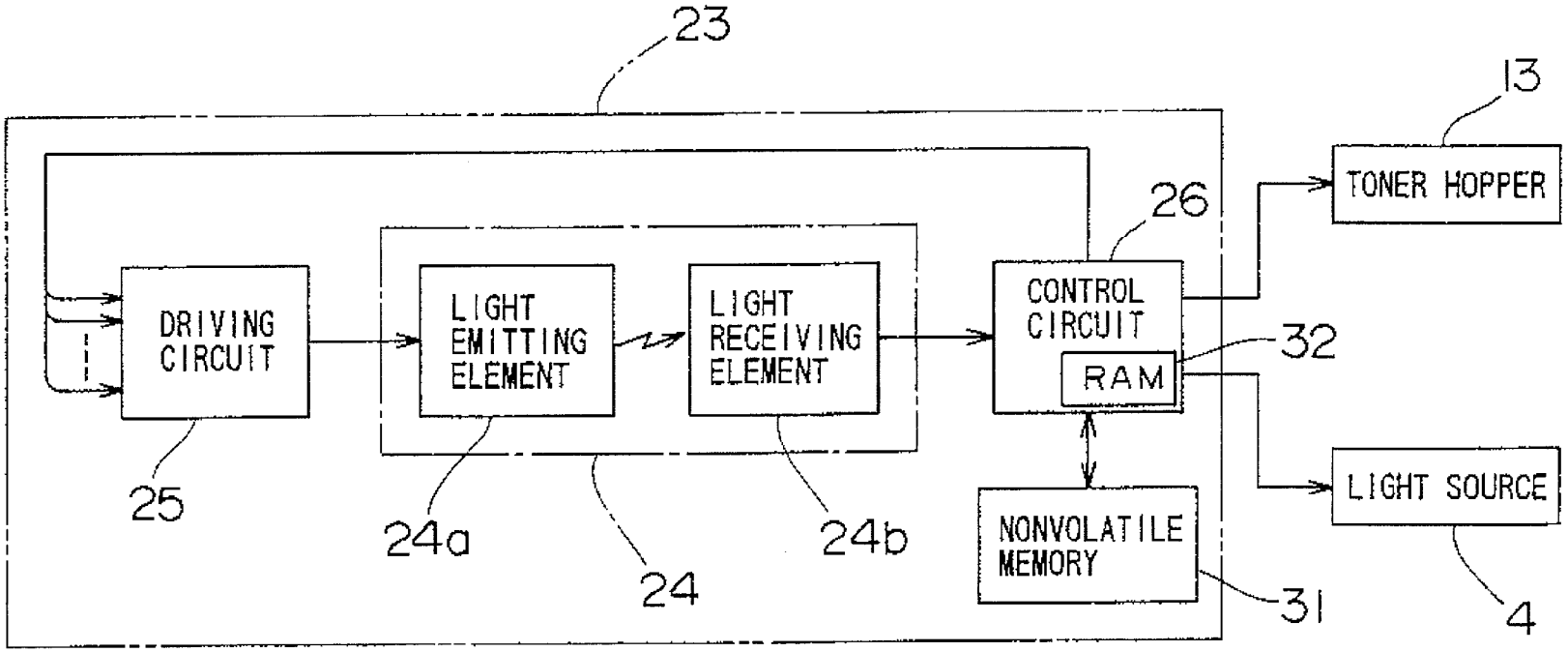
FIG. 2 is a block diagram showing the electrical construction of the density detecting device.

FIG. 2 is a block diagram showing the electrical construction of the density detecting device 23. The density detecting device 23 is made use of at the time of image forming condition adjusting processing as described later in order to adjust the density of an image to be formed on the copy paper 16. At the time of the image forming condition adjusting processing, either one of the pseudo originals 22*a* or 22*b* is experimentally illuminated, thereby forming a toner image having a density corresponding to the pseudo original on the photosensitive drum 10. The density of the formed toner image is detected by the density detecting device 23, and the image forming conditions such as the amount of exposure and the amount of toner to be supplied to the developing device 14 are adjusted on the basis of the results of the detection.

As described above, the density detecting device 23 includes the reflection type photosensor 24. The reflection type photosensor 24 includes a light emitting element 24*a* composed of a light emitting diode (LED) for irradiating light of a predetermined amount onto the photosensitive drum 10, for example, and a light receiving element 24*b* composed of a Darlington type phototransistor for receiving light reflected from the photosensitive drum 10, for example, and is driven by a driving circuit 25.

A code represented by a binary code corresponding to a voltage to be supplied to the light emitting element 24*a* is fed from a control circuit 26 to the driving circuit 25. The control circuit 26 generates the code corresponding to the voltage to be applied to the light emitting element 24*a* in accordance with a predetermined program. The driving circuit 25 applies a voltage corresponding to the fed code to the light emitting element 24*a*. Consequently, light in an amount corresponding to the voltage is irradiated onto the photosensitive drum 10.

A part of the light irradiated onto the photosensitive drum 10 is reflected from the surface of the photosensitive drum 10, and the remaining part is absorbed by toner on the surface of the photosensitive drum 10. Consequently, light in a relatively large amount is reflected if a toner image density is relatively low, while light in a relatively small amount is reflected if a toner image density is relatively high.

The above described reflected light is received by the light receiving element 24*b*. The light receiving element 24*b* generates density data inversely proportional to the amount of the reflected light and feeds the generated density data to the control circuit 26. That is, density data corresponding to the toner image density is fed to the control circuit 26.

Figure 3:
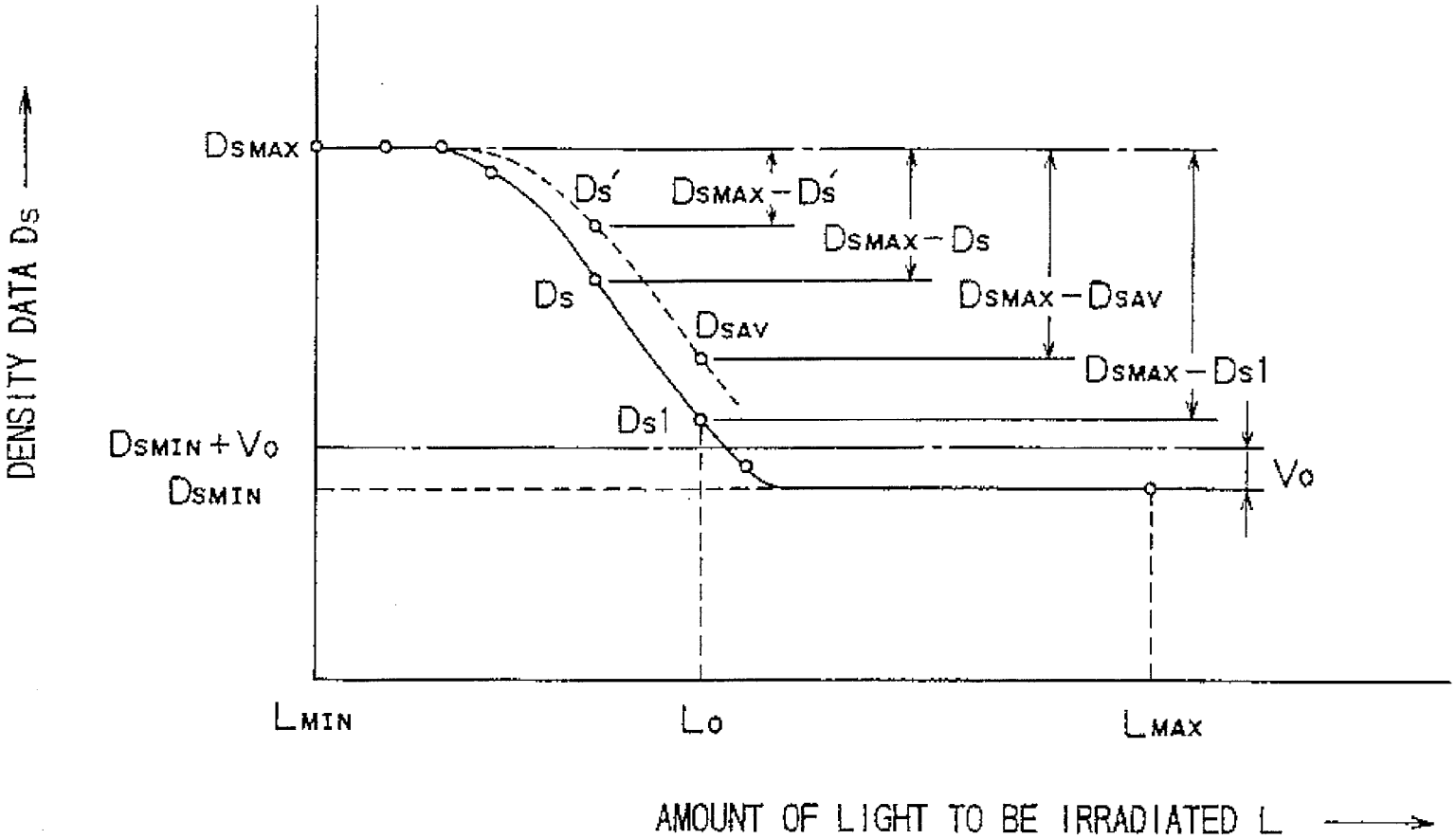
FIG. 3 is a graph showing the relationship between an amount of light to be irradiated onto a photosensitive drum which has not been developed from a reflection type photosensor constituting a part of the density detecting device and density data.

A graph showing the relationship between the amount of light irradiated from the reflection type photosensor 24 onto the photosensitive drum 10 which has not been developed and density data fed to the control circuit 26 from the reflection type photosensor 24 is indicated by a solid line in FIG. 3.

Turning to FIG. 2, the above described control circuit 26 is constituted by a microcomputer comprising a CPU (Central Processing Unit), a RAM (Random Access Memory) 32 and a ROM (Read-only Memory), for example, and has the function of performing initialization processing and image forming condition adjusting processing as described later on the basis of the output density from the light receiving element 24*b*. A programmable nonvolatile memory 31 for storing data related to the input-output characteristics of the reflection type photosensor 24 is connected to the control circuit 26. The nonvolatile memory 31 may be composed of a RAM with a backup power supply or an EEPROM (Electrically Erasable and Programmable ROM), for example.

Figure 4:
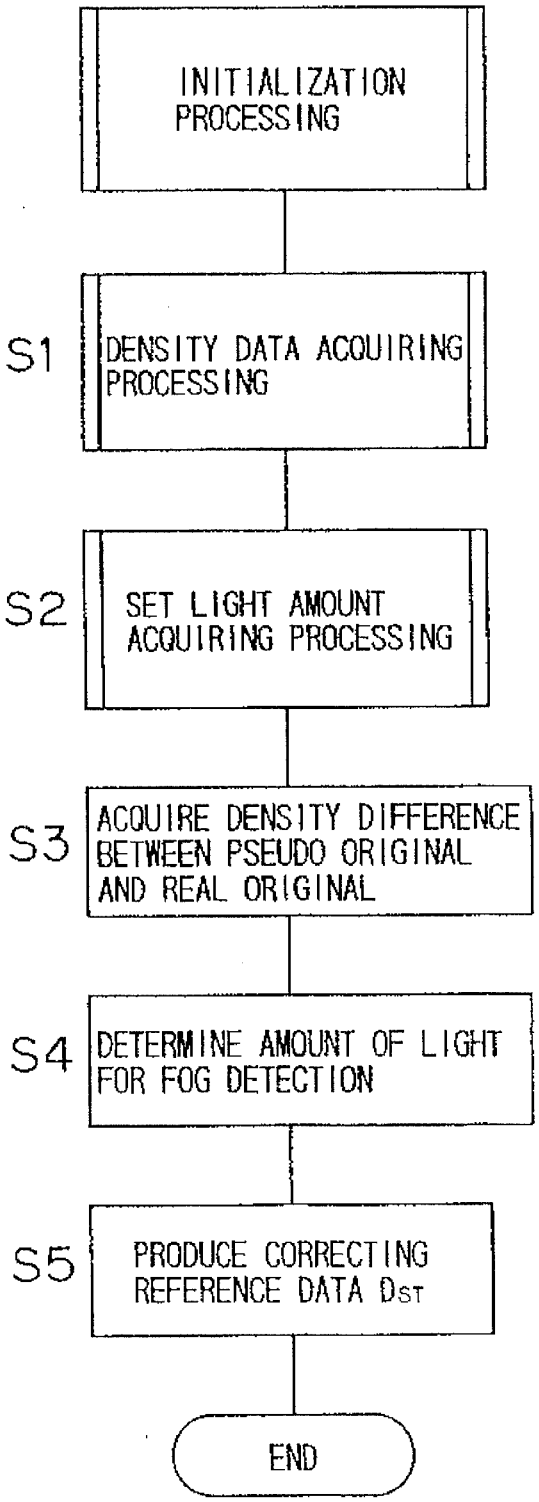
FIG. 4 is a flow chart for explaining initialization processing performed in a control circuit constituting a part of the density detecting device.

FIG. 4 is a flow chart for explaining initialization processing. In the initialization processing, density data acquiring processing for acquiring density data is first performed (step S1). Specifically, output data from the light receiving element 24*b* which correspond to amounts of light in a plurality of steps to be irradiated from the light emitting element 24 onto the photosensitive drum which has not been developed (on which no toner adheres). Set light amount acquiring processing for acquiring a first amount of light for low density $LN_1$ and a first amount of light for high density $LX_1$ is then performed on the basis of the density data acquired by the density data acquiring processing (step S2).

At the time of image forming condition adjusting processing as described later, a second amount of light for low density $LN_2$ is found similarly to the first amount of light for low density $LN_1$, and a second amount of light for high density $LX_2$ is found similarly to the first amount of light for high density $LX_1$. The second amount of light for low density $LN_2$ or the second amount of light for high density $LX_2$ is used for detecting fog, and the second amount of light for high density $LX_2$ is used for detecting a solid black.

Figure 5:
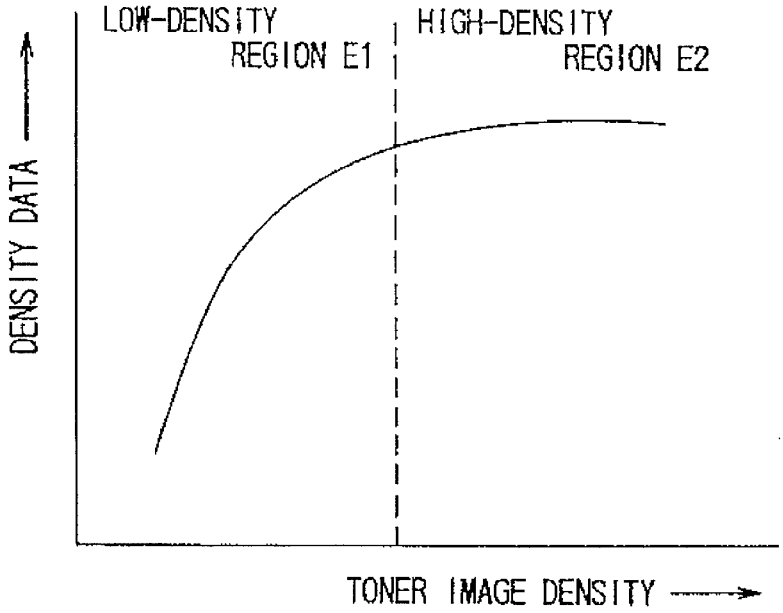
FIG. 5 is a graph showing the relationship between a toner image density and an output of the reflection type photosensor in a case where an amount of light for low density is set in the reflection type photosensor.

FIG. 5 is a diagram showing the relationship between a toner image density on the surface of the photosensitive drum and density data outputted from the reflection type photosensor 24 in a case where the amount of light for low density $LN_1$ or $LN_2$ is set. Referring to FIG. 5, the density data outputted from the reflection type photosensor 24 relatively linearly changes in a low-density region E1, while hardly changes in a high-density region E2. That is, in the above described reflection type photosensor 24, the change in density in the low-density region E1 can be detected with high precision when the amount of light for low density $LN_1$ or $LN_2$ is set. Therefore, it is possible to detect fog with high precision.

Figure 6:
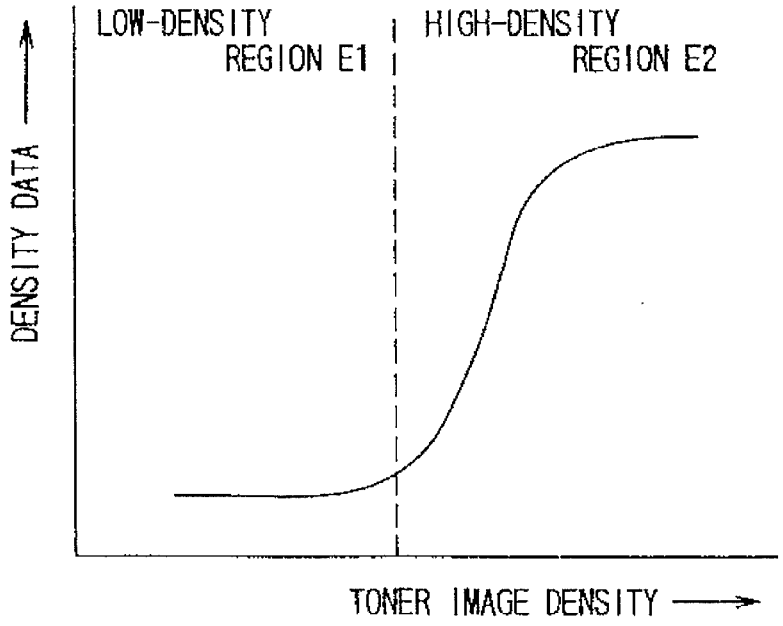
FIG. 6 is a graph showing the relationship between a toner image density and an output of the reflection type photosensor in a case where an amount of light for high density is set in the reflection type photosensor.

FIG. 6 is a diagram showing the relationship between a toner image density and density data outputted from the reflection type photosensor 24 in a case where the amount of light for high density $LX_1$ or $LX_2$ is set. Referring to FIG. 6, the density data outputted from the reflection type photosensor 24 hardly changes in the low-density region E1, while relatively linearly changes in the high-density region E2. That is, in the reflection type photosensor 24, the change in density in the high-density region E2 can be detected with high precision when the amount of light for high density $LX_1$ or $LX_2$ is set. Therefore, it is possible to detect a solid black with high precision.

It is also possible to set an amount of light capable of covering both the low-density region E1 and the high-density region E2. If such an amount of light is set, however, the change of density data corresponding to the change of the toner image density is reduced. As a result, it may be difficult to detect the toner image density with high precision.

In adjusting the image forming conditions, either the pseudo original 22*a* or 22*b* is illuminated, and the toner image is formed on the surface of the photosensitive drum 10, as described above. Even if the density of the real original 1 and the density of the pseudo originals 22*a* or 22*b* are equal, however, the amount of reflected light introduced into the photosensitive drum 10 (the amount of exposure) differs due to a structural factor peculiar to each electrostatic copying machine such as the difference in the set position between a case where the pseudo originals 22*a* or 22*b* are illuminated and a case where the real original 1 is illuminated and scanned. For example, where the pseudo originals 22*a* and 22*b* are closer to the light source 4 compared with the real original 1, the amount of exposure when the real original 1 is illuminated and scanned is made larger than that when the pseudo originals 22*a* or 22*b* are illuminated. The reason for this is that the light source 4 is generally designed so that light is converged on the surface of the real original 1. Consequently, there is a difference between the density of a toner image formed by illuminating and scanning a pure white region of the real original 1 and the density of a toner image formed by illuminating the pseudo original 22*a* on which a pure white image is formed. Specifically, even under the conditions in which no fog is observed in a toner image corresponding to a pure white real original 1, a relatively high density toner image may be formed by illuminating the pseudo original 22*a*. The fog detection utilizing the pseudo original 22*a* may therefore be inferior with the light amount for low density in some machines. Thus, the image density is not always properly adjusted.

In the initialization processing according to the present embodiment, the difference in the density between a toner image formed by illuminating the real original 1 on which a pure white image is formed and a toner image formed by illuminating the pure white pseudo original 22*a* is found, as shown in FIG. 4 (step S3). Either the second amount of light for low density $LN_2$ or the second amount of light for high density $LX_2$ is chosen as the amount of light to be irradiated for fog detection depending on whether or not the found difference in the density is not less than a predetermined threshold value (step S4).

For example, when the above described difference in the density is not less than the above described threshold value, the density of the toner image formed by illuminating the pseudo original 22*a* becomes relatively high, whereby the second amount of light for high density $LX_2$ is taken as the amount of light to be irradiated for fog detection. If the difference in the density is less than the threshold value, the density of the toner image formed by illuminating the pseudo original 22*a* is not too high. Accordingly, the second amount of light for low density $LN_2$ is employed for fog detection.

On the other hand, at the time of the initialization, the first amount of light for low density $LN_1$ and the first amount of light for high density $LX_1$ are found, as described above. At the time of image forming condition adjusting processing, a second amount of light for low density $LN_2$ is found similarly to the first amount of light for low density $LN_1$, and a second amount of light for high density $LX_2$ is found similarly to the first amount of light for high density $LX_1$. In detecting a toner image density corresponding to the pseudo originals 22*a* and 22*b* at the time of the image forming condition adjusting processing, when the second amount of light for low density $LN_2$ is set, the input-output characteristics of the reflection type photosensor 24 are not so different from the input-output characteristics in a case where the first amount of light for low density $LN_1$ is set at the time of the initialization. When the second amount of light for low density $LN_2$ is set to detect the toner image density, therefore, it is safe to refer to the input-output characteristics of the sensor 24 in a case where the first amount of light for low density $LN_1$ is set at the time of the initialization. On the other hand, the input-output characteristics of the photosensor 24 in a case where the second amount of light for high density $LX_2$ is set at the time of the image forming condition adjusting processing significantly deviate from the input-output characteristics of the photosensor 24 in a case where the first amount of light for high density $LX_1$ is set at the time of the initialization. The reason for this is that the amounts of light for low density $LN_1$ and $LN_2$ are set on the basis of the actual results of the density detection, while the amounts of light for high density $LX_1$ and $LX_2$ are found by substituting the amounts of light for low density $LN_1$ and $LN_2$ in conversion equations as described later. That is, a suitable relationship between the amount of light for low density and the amount of light for high density differs depending on which of the initialization and the image forming condition adjusting processing is performed. Toner and paper particles adhering on a light emitting surface and a light receiving surface of the reflection type photosensor 24 are the main cause.

When the second amount of light for high density $LX_2$ is set at the time of the image forming condition adjusting processing, therefore, the input-output characteristics of the reflection type photosensor 24 in a case where the first amount of light for high density $LX_1$ is set at the time of the initialization processing cannot be referred to as they are. In the initialization processing according to the present embodiment, therefore, correcting reference data $D_{ST}$ for correcting the density data outputted from the reflection type photosensor 24 in which the second amount of light for high density $LX_2$ is set at the time of the image forming condition adjusting processing is found (step S5).

More specifically, the first amount of light for low density $LN_1$ is first set in the reflection type photosensor 24. The pseudo original 22*a* is illuminated while varying the amount of illuminating light from the light source 4, whereby a toner image forming operation is performed. Consequently, a toner image having a plurality of regions which differ in density is formed on the surface of the photosensitive drum 21. The density in each region of the toner image is detected by the reflection type photosensor 24, and density data outputted by the photosensor 24 is acquired in the region. The actual density of the toner image corresponds to the amount of exposure corresponding to each of the regions, thereby obtaining a low-density set light amount characteristic curve representing the relationship between a toner image density and density data. In the low-density set light amount characteristic curve, a toner image density corresponding to predetermined first density data $D_0$ is acquired as a first reference density $ID_0$.

The first amount of light for high density $LX_1$ is then set in the reflection type photosensor 24. Similarly to the foregoing, the pseudo original 22*a* is illuminated while varying the amount of illuminating light from the light source 4, whereby a toner image forming operation is performed. Consequently, a high-density set light amount characteristic curve representing the relationship between a toner image density and density data in a case where the first amount of light for high density $LX_1$ is set is obtained. In the high-density set light amount characteristic curve, density data corresponding to the first reference density $ID_0$ is set as the correcting reference data $D_{ST}$.

The low-density set light amount characteristic curve and the high-density set light amount characteristic curve are stored in the nonvolatile memory 31, and are made use of at the time of the image forming condition adjusting processing.

Consequently, the initialization processing is achieved.

Figure 7:
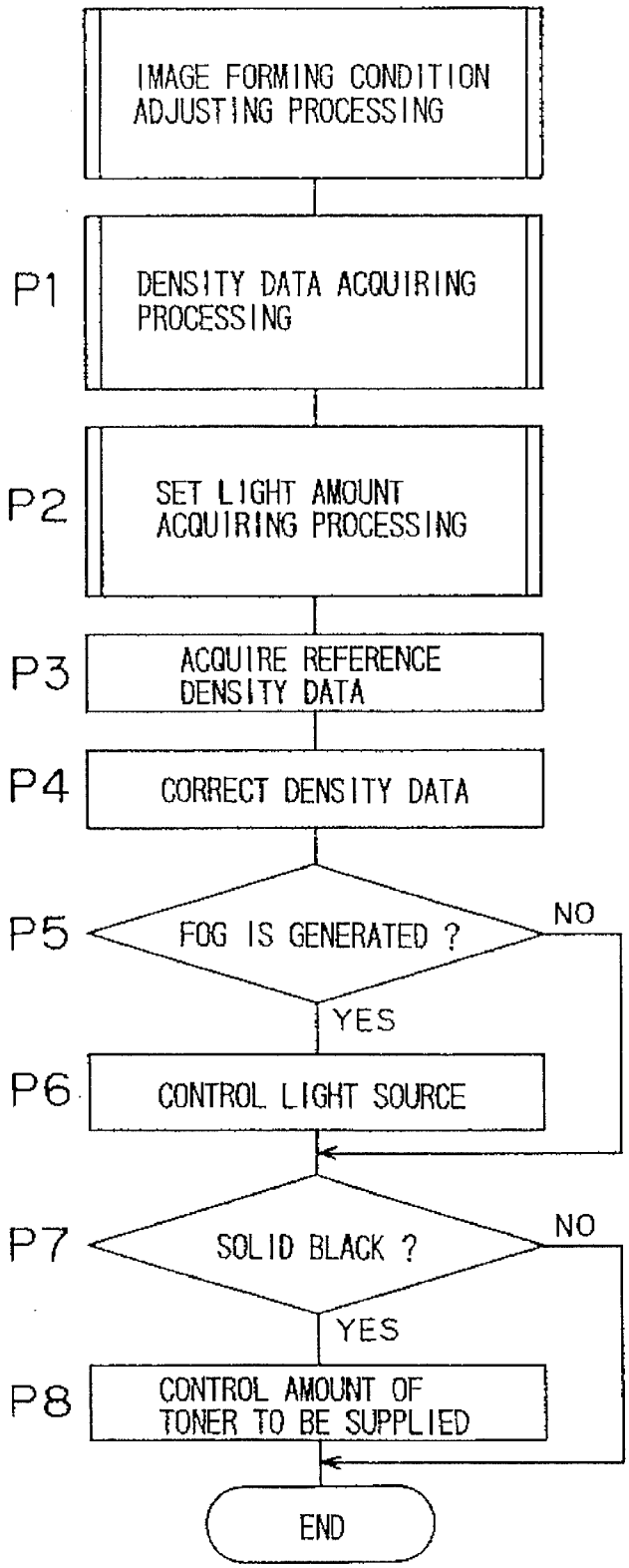
FIG. 7 is a flow chart for explaining image forming condition adjusting processing performed in the control circuit.

FIG. 7 is a flow chart for explaining the image forming condition adjusting processing. The image forming condition adjusting processing is performed for each predetermined time period (for example, for every 60,000 copies), for example, at the time of maintenance. More specifically, the same processing as the density data acquiring processing and the set light amount acquiring processing in the initialization processing is first performed. The second amount of light for low density $LN_2$ is found in the same manner as to find the first amount of light for low density $LN_1$, and the second amount of light for high density $LX_2$ is acquired in the same manner as to acquire the first amount of light for high density $LX_1$ (steps P1 and P2). A second reference density $ID_1$ is then found (step P3). The second reference density $ID_1$ is found in approximately the same manner as the first reference density $ID_0$. That is, density data slightly lower than the saturation point of the output of the reflection type photosensor 24 in which the second amount of light for low density $LN_2$ is set is taken as a second density data $D_1$. In the second amount of light for low density $LN_2$, a toner image density corresponding to the second density data $D_1$ is set as the second reference density $ID_1$. The second reference density $ID_1$ is approximately the same as the first reference density $ID_0$. The second density data $D_1$ takes a value within the range of precision of $\pm\alpha$(for example, $\alpha$=0.02 (V)) with respect to the first density data $D_0$, that is, $D_0\pm\alpha$.

When the second reference density $ID_1$ is found, the density data outputted from the reflection type photosensor 24 in a case where the first amount of light for high density $LX_1$is set in the reflection type photosensor 24 at the time of the initialization is corrected (step P4). That is, a plurality of density data $D_S$DAT acquired with respect to toner images having densities in a plurality of steps in a state where the first amount of light for high density $LX_1$ is set at the time of the initialization processing are corrected. The density data $D_S$DAT are the data forming the above described high-density set data curve M2 and are stored in the non-volatile memory 31.

More specifically, the pseudo original **22*a* is first illuminated with an amount of exposure corresponding to the second reference density $ID_1$. A toner image having the second reference density $ID_1$ is formed on the surface of the photosensitive drum 10 by the function of the developing device 14 and the like. The density of the toner image having the second reference density $ID_1$ is detected by the reflection type photosensor 24** in which the second amount of light for high density $LX_2$ is set, and outputted density data is taken as second reference data $D_{SF}$.

When the second reference data $D_{SF}$ is found, a correction factor K is found by the following equation on the basis of the second reference data $D_{SF}$ and the correcting reference data $D_{ST}$ found at the time of the initialization processing:

$$K=D_{ST}/D_{SF} \quad (1)$$

The plurality of density data $D_S$DAT acquired at the time of the initialization processing are used in a form corrected on the basis of the correction factor K. That is, at the time of the image forming condition adjusting processing, the plurality of density data acquired at the time of the initialization are treated as density data $D_S$DAT' after the correction indicated by the following equation (2). The data $D_S$DAT' after the correction are stored in the RAM 32 in the control circuit 26 establishing correspondence with the data $D_S$DAT before the correction.

$$D_sDAT'=K\times D_sDAT \quad (2)$$

For example, the actual output data of the reflection type photosensor 24 corresponding to the reference density $ID_0$is $D_{SF}$. Data after the correction of density data corresponding to the density data $D_{SF}$ which are acquired at the time of the initialization processing is as follows when it is calculated in accordance with the foregoing equation (2):

$$D_sDAT'=K\times D_{SF}=(D_{ST}/D_{SF})\times D_{SF}=D_{ST} \quad (3)$$

When the data $D_S$DAT' (=$D_{ST}$) after the correction is regarded as data acquired at the time of the initialization processing, and is applied to the high-density set data curve acquired at the time of the initialization processing, the toner image density $ID_0$ is obtained.

Even when the input-output characteristics, which correspond to the second amount of light for high density $LX_2$, of the reflection type photosensor 24 thus differ from the input-output characteristics which correspond to the first amount of light for high density $LX_1$ acquired at the time of the initialization, the toner image density can be accurately detected making use of the high-density set light amount characteristic curve obtained at the time of the initialization by the above described correction.

The second amount of light for low density $LN_2$ is suitably set on the basis of the actual results of the detection, whereby the input-output characteristics of the reflection type photosensor 24 in a case where the second amount of light for low density $LN_2$ is set at the time of the image forming condition adjusting processing is approximately the same as that in a case where the first amount of light for low density $LN_1$ is set at the time of the initialization. When the second amount of light for low density $LN_2$ is set, therefore, the low-density set light amount characteristic curve acquired at the time of the initialization processing can be used as it is without being corrected.

When the correction of the density data $D_S$DAT is terminated (step P4), it is then determined whether or not fog is generated (step P5). Specifically, a toner image forming operation is performed at the same time of illumination onto the pseudo original **22*a* on which a pure white image is formed. The amount of light to be irradiated onto the photosensitive drum 10 from the reflection type photosensor 24 is the set amount of light selected as the amount of light for detecting fog in the initialization processing out of the second amount of light for low density $LN_2$ and the second amount of light for high density $LX_2$. It is determined whether or not fog is generated on the basis of the density data outputted from the reflection type photosensor 24**.

As a result, when it is determined that fog is generated, the amount of light to be emitted from the light source 4 is increased (step P6).

A solid black is then detected (step P7). Specifically, the pseudo original **22*b* on which a solid black image is formed is illuminated, whereby forming a toner image corresponding to the pseudo original 22*b* on the surface of the photosensitive drum 10. The density of the formed toner image is detected by the reflection type photosensor 24. At this time, the second amount of light for high density $LX_2$ is set as the amount of light to be irradiated from the reflection type photosensor 24. It is determined whether or not the toner image is solid black on the basis of the density data outputted from the reflection type photosensor 24**.

As a result, when it is determined that the toner image is not solid black, the toner hopper 13 is controlled. Specifically, the amount of toner to be supplied to the developing device 14 from the toner hopper 13 is increased (step P8).

Consequently, the adjustment of the image forming conditions is achieved, thereby making it possible to stably acquire an image high in quality.

When the second amount of light for high density $LX_2$ is set, the density data which is closest to the data outputted from the reflection type photosensor 24 out of the density data $D_S$DAT acquired at the time of the initialization is found out. Density data $D_S$DAT' after the correction corresponding to the density data $D_S$DAT is read out from the RAM 32 in the control circuit 26. Further, in the above described high-density set data curve, a toner image density corresponding to the read data $D_S$DAT' after the correction is found out. The toner image density is regarded as the density of a toner image which is an object to be detected.

As a result, when the first amount of light for high density $LX_1$ is set in the reflection type photosensor 24, the data $D_s$ outputted by the reflection type photosensor 24 is corrected in accordance with the following equation (4). Data $D_s''$ after the correction is applied to the input-output characteristics at the time of the initialization, thereby detecting a toner image density.

$$D_s''=K\times D_s \tag{4}$$

Figure 8:
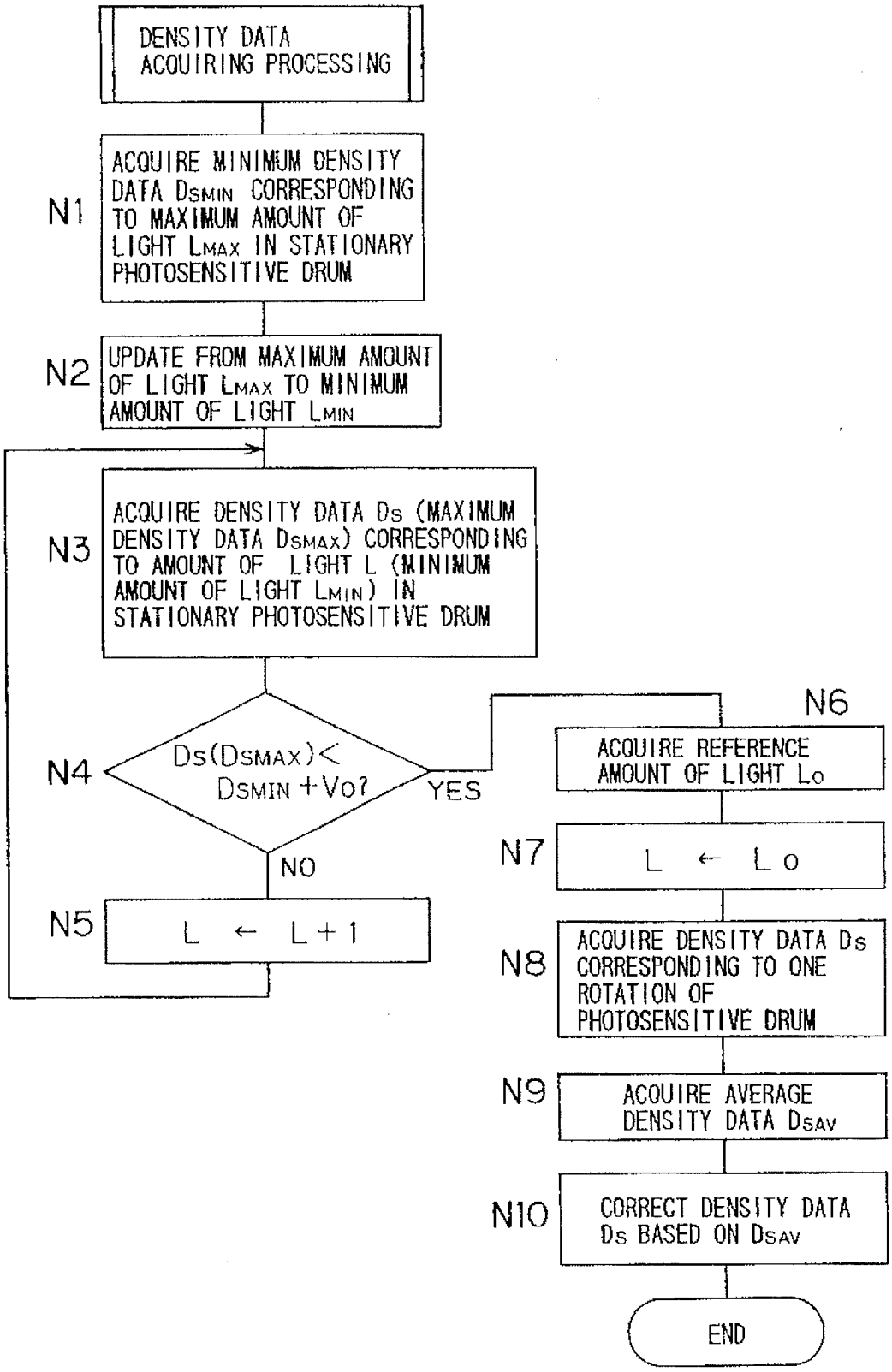
FIG. 8 is a flow chart for explaining density data acquiring processing in the electrostatic copying machine.

FIG. 8 is a flow chart for explaining density data acquiring processing respectively performed in the step S1 shown in FIG. 4 and the step P1 shown in FIG. 7. FIG. 3 will be also referred to in the following description. The density data acquiring processing is performed with the photosensitive drum 10 standing still after performing an image forming operation with the amount of illuminating light from the light source 4 maximized to bring the photosensitive drum 10 into an undeveloped state where no toner adhere.

Light of the maximum amount $L_{MAX}$ out of amounts of light in a plurality of steps previously set is irradiated onto the photosensitive drum 10 from the light emitting element 24*a* in a state where the photosensitive drum 10 is kept stationary. Once density data $D_s$ which is output data of the light receiving element 24*b* and which corresponds to the amount of the reflected light from the photosensitive drum 10 has been acquired, the acquired density data $D_S$ is stored as minimum density data $D_{SMIN}$ in the RAM 32 in the control circuit 26 (step N1). The amount of light to be irradiated from the light emitting element 24*a* is updated from the maximum amount of light $L_{MAX}$ to the minimum amount of light $L_{MIN}$ (step N2). Once light of the minimum amount $L_{MIN}$ is irradiated onto the photosensitive drum 10 from the light emitting element 24*a*, and density data $D_S$ corresponding to the amount of the reflected light from the photosensitive drum 10 has been acquired, the acquired density data $D_S$ is stored as maximum density data $D_{SMAX}$ in the RAM 32 (step N3).

The maximum value $D_{MAX}$ and the minimum value $D_{SMIN}$ of the density data are thus first acquired.

Thereafter, it is judged whether or not the acquired density data $D_S$ satisfies the following expression (for example, $V_0$=0.2 (V)) (step N4):

$$D_S<D_{SMIM}+V_0 \tag{5}$$

Since the density data $D_S$ is originally the maximum density data $D_{SMAX}$, it is judged whether or not the following expression is satisfied:

$$D_{SMAX}<D_{SMIN}+V_0 \tag{6}$$

Since the foregoing expression (6) is not generally satisfied, the program then proceeds to the step N5. In the step N5, an amount of light L to be irradiated from the reflection type photosensor 24 is raised by one step. As in the foregoing step N3, light of the amount L raised by one step is irradiated onto the photosensitive drum 10 from the light emitting element 24*a*, and density data $D_S$ corresponding to the amount of the reflected light is stored in the RAM 32.

The operations in the foregoing steps N3 to N5 are repeatedly performed until it is Judged in the foregoing step N4 that the foregoing expression (5) is satisfied. If it is judged in the foregoing step N4 that the foregoing expression (5) is satisfied, an amount of light corresponding to density data $D_S$1 which has been acquired immediately before the density data $D_S$ acquired at the time of the judgment is stored as a reference amount of light $L_0$ in the RAM 32 (step N6). That is, the maximum amount of light satisfying $D_S \geqq D_{SMIN}+V_0$ is the reference amount of light $L_0$. If $D_S<D_{SMIN}+V_0$, an output of the sensor 24 is saturated. Even if the amount of light to be irradiated is increased after the expression is satisfied, the density data $D_S$ hardly changes. Consequently, the reference amount of light $L_0$ is an amount of light slightly smaller than the amount of light in which the output of the sensor 24 is saturated. The constant $V_0$ is determined by experiments so that an amount of light in which the output of the sensor 24 shows sufficient change with respect to the change in density is set as the reference amount of light $L_0$.

When the reference amount of light $L_0$ is found in the foregoing step N6, the amount of light L to be irradiated from the light emitting element 24*a* is then set to the reference amount of light $L_0$ (step N7). The photosensitive drum 10 is then rotated, and light in the reference amount $L_0$ is irradiated onto the photosensitive drum 10 from the light emitting element 24*a* for each predetermined period (for example, 16 (msec), 49 times). As a result, the density data $D_S$ corresponding to the reference amount of light $L_0$ are acquired in a plurality of portions distributed on the periphery of the photosensitive drum 10 (step N8). The average of a plurality of density data $D_S$ acquired in the plurality of portions is found as the average density data $D_{SAV}$ corresponding to the reference amount of light $L_0$ (step N9).

Since the above described density data $D_{SAV}$ is acquired by irradiating light onto the photosensitive drum 10 being rotated once, as described above, it corresponds to density data considering the variation in the circumferential direction of the photosensitive drum 10.

After the density data $D_{SAV}$ is acquired, the density data $D_S$ other than the density data $D_S$, acquired in the foregoing step N3 which corresponds to the reference amount of light $L_0$ are corrected on the basis of the acquired density data $D_{SAV}$ (step N10).

More specifically, if the density data after the correction is taken as $D_S'$, the following expression (7) holds:

$$(D_{SMAX}-D_S'):(D_{SMAX}-D_S)=(D_{SMAX}-D_{SAV}):(D_{SMAX}-D_S1) \tag{7}$$

whereby $$(D_{SMAX}-D_S')/(D_{SMAX}-D_S)=(D_{SMAX}-D_{SAV})/(D_{SMAX}-D_S1) \tag{8}$$

Therefore, the density data $D_S'$ after the correction is as follows:

$$D_S'=D_S(D_{SMAX}-D_{SAV})/(D_{SMAX}-D_S1)+D_{SMAX}(D_{SAV}-D_S1)/(D_{SMAX}-D_S1) \tag{9}$$

The density data $D_S$ is thus corrected. Specifically, the density data $D_S$ corresponding to the amounts of light to be irradiated L other than the reference amount of light $L_0$ acquired with the photosensitive drum 10 kept in a stationary state are corrected as if they are data acquired by rotating the photosensitive drum 10 once. Therefore, it is possible to obtain accurate density data considering the variation in the circumferential direction of the photosensitive drum 10 with respect to all the amounts of light to be irradiated L.

Thus, the density data acquiring processing is achieved.

Figure 9:
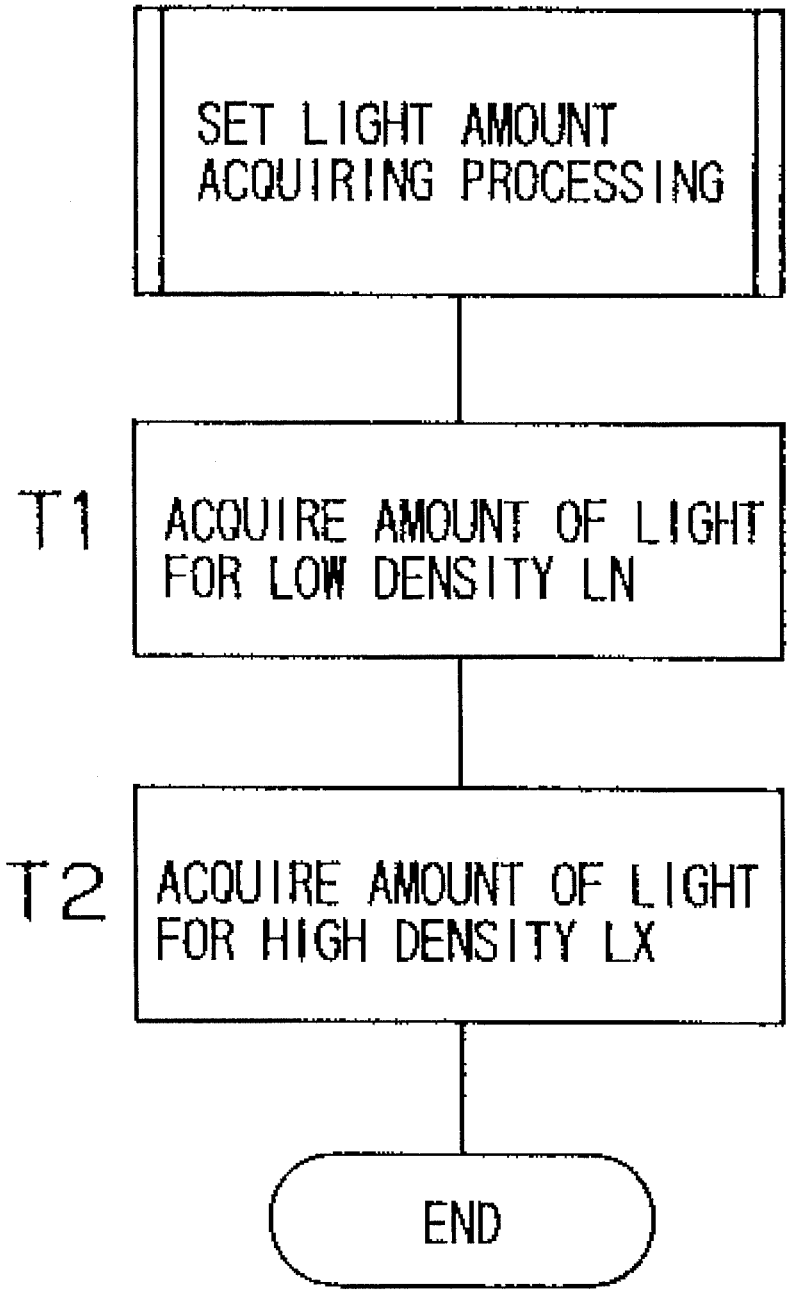
FIG. 9 is a flow chart for explaining set light amount acquiring processing in the electrostatic copying machine.

FIG. 9 is a flow chart for explaining the set light amount acquiring processing respectively performed in the step S2 shown in FIG. 4 and the step P2 shown in FIG. 7. Although the first amount of light for low density $LN_1$ and the first amount of light for high density $LX_1$ are found in the step S2 shown in FIG. 4, and the second amount of light for low density $LN_2$ and the second amount of light for high density $LX_2$ are found in the step P2 shown in FIG. 7, processings are identical to each other. Therefore, the first and second amounts of light for low density $LN_1$ and $LN_2$ will be generically named an amount of light for low density LN hereinafter. Similarly, the first and second amounts of light for high density $LX_1$ and $LX_2$ will be generically named an amount of light for high density LX hereinafter.

In the set light amount acquiring processing, the amount of light for low density LN is first acquired. Specifically, in the density data acquiring processing, an amount of light L corresponding to the minimum density data $D_S'$ which satisfies the following expression (10) (the maximum amount of light for which the following expression (10) is satisfied) out of the density data $D_S'$ after the correction acquired with respect to the amounts of light in the plurality of steps is set as the amount of light for low density LN (step T1):

$$D_S' > D_{SMIN} + V_0' \quad (10)$$

where $V_0'$=0.4 (V), for example.

It is preferable that the density data $D_S'$ which do not satisfy the foregoing expression (10) are not used because they are data in a region where the output of the sensor 24 is saturated. The constant $V_0'$ is determined by experiments so that the amount of light in which the change of the output of the sensor 24 with the change in density can be sufficiently increased is set as the amount of light for low density LN.

Once the amount of light for low density LN has been found, the amount of light for high density LX is then found (step T2). For example, where the amounts of light L can be set in sixty-four steps from the step 0 to the step 63, the amount of light for high density LX may be determined in the following manner. Specifically, if the amount of light for low density LN has a value within a range from the minimum amount of light $L_{MIN}$ to the amount of light $L_{MIN+15}$ in the 15-th step, the amount of light for high density LX may be found from the following equation:

$$LX = 2LN + 2 \quad (11)$$

Furthermore, if the amount of light for low density LN has a value within a range from the amount of light $L_{MIN+16}$ in the 16-th step to the amount of light in the 23-rd step, the amount of light for high density LX may be found from the following equation:

$$LX = 0.108LN^2 - 0.28LN + 11 \quad (12)$$

If LN >23, the amount of light for high density LX must take a value of not less than 64, whereby the setting becomes impossible. In such a case, it is considered that any abnormality occurs in the density detecting device 23.

In preparing the foregoing conversion equation, suitable values of the amount of light for high density LX are respectively found by experiments with respect to a plurality of values of the amount of light for low density LN. The conversion equation is determined so that the results of the experiments can be approximated.

For example, a density intermediate between the density of a toner image on the photosensitive drum 10 which has not been developed and the density of a solid black toner image will be referred to as an intermediate density hereinafter. It is preferable that the amount of light for low density LN is set so that the output of the reflection type photosensor 24 reaches the maximum (the top) at the intermediate density. On the other hand, it is preferable that the amount of light for high density LX is set so that the output of the reflection type photosensor 24 rises at the intermediate density and reaches the maximum (the top) at the solid black density.

The following Table 1 represents a correspondence between the amount of light for low density LN and the amount of light for high density LX.

TABLE 1

| amount of light for low density LN (step) | amount of light for high density LX (step) |
|---|---|
| 0 | 2 |
| 1 | 4 |
| 2 | 6 |
| 3 | 8 |
| 4 | 10 |
| 5 | 12 |
| 6 | 14 |
| 7 | 16 |
| 8 | 18 |
| 9 | 20 |
| 10 | 22 |
| 11 | 24 |
| 12 | 26 |
| 13 | 28 |
| 14 | 30 |
| 15 | 32 |
| 16 | 34 |
| 17 | 37 |
| 18 | 41 |
| 19 | 45 |
| 20 | 49 |
| 21 | 53 |
| 22 | 57 |
| 23 | 62 |

As described in the foregoing, in the electrostatic copying machine according to the present embodiment, when density data required in finding the amount of light for low density LN and the amount of light for high density LX to be set in the reflection type photosensor 24 are found, density data are acquired in respective portions distributed over the periphery of the photosensitive drum 10 only with respect to the reference amount of light $L_0$ which is one of the amounts of light L in the plurality of steps. With respect to the amounts of light to be irradiated L in other steps, density data is acquired only at one point with the photosensitive drum 10 being in the stationary state. Consequently, accurate density data can be acquired in a shorter time, as compared with the prior art in which density data are acquired in respective portions over the periphery of the photosensitive drum 10 with respect to the amounts of light in all the steps. Therefore, total time required to irradiate light onto the photosensitive drum 10 can be made shorter, as compared with that in the prior art, thereby making it possible to reduce the light-induced fatigue of the photosensitive drum 10.

Furthermore, the density data can be acquired in a short time, thereby making it possible to easily increase the number of steps of the amounts of light L to be irradiated from the reflection type photosensor 24. Therefore, it is possible to detect a toner image density with higher precision.

Although description has been made of the embodiment of the present invention, the present invention is not limited to the above described embodiment. For example, although in the above described embodiment, an electrostatic copying machine is taken as an example, the present invention is also applicable to an arbitrary image forming apparatus in which an image is formed by the electrophotographic process, for example, a laser beam printer or a facsimile.

Although the present invention has been described and illustrated in detail, it is clearly understood that the description is by way of illustration and example only and is not to be taken by way of limitation, the spirit and scope of the present invention being limited only by the terms of the appended claims.

What is claimed is:

1. A method of adjusting a density detecting device in an image forming apparatus, the image forming apparatus including a photoreceptor on which an electrostatic latent image is formed, a developing device for developing the electrostatic latent image formed on the photoreceptor into a toner image, and the density detecting device for irradiating light of a predetermined amount onto the photoreceptor to output density data corresponding to the amount of reflected light from the photoreceptor, the method comprising the steps of:

successively irradiating light of amounts in a plurality of steps from a maximum amount to a minimum amount from the density detecting device onto one point of the photoreceptor on which no toner adheres, to acquire a plurality of density data outputted by the density detecting device which correspond to the amounts of light in the respective steps;

selecting one density data on a predetermined basis out of the plurality of acquired density data corresponding to the amounts of light of the plurality of steps;

irradiating light in the amount in the step corresponding to the selected one density data from the density detecting device onto a plurality of points of the photoreceptor, to acquire density data outputted by the density detecting device at the respective points;

finding an average value of the acquired density data corresponding to the plurality of points as average density data;

correcting the plurality of acquired density data corresponding to the amounts of light in the plurality of steps on the basis of the average density data and the selected one density data; and setting an amount of light to be irradiated onto the photoreceptor from the density detecting device when a density of a toner image formed on the photoreceptor is detected, on the basis of the plurality of the density data corrected.

2. The method according to claim 1, wherein the step of correcting the plurality of density data includes the step of correcting the density data corresponding to the amount of light in each of the steps on the basis of the density data corresponding to the amount of light in the step, the density data corresponding to the maximum amount of light, and the average density data, and the selected one density data.

3. The method according to claim 1, wherein the step of correcting the plurality of density data includes the step of correcting the density data corresponding to the amount of light in each of the steps on the basis of a difference between the density data corresponding to the maximum amount of light and the average density data, the difference between the density data corresponding to the maximum amount of light and the selected one density data, and a difference between the average density data and the selected one density data.

4. The method according to claim 3, wherein the step of correcting the plurality of density data includes the step of operating density data $D_S$ corresponding to the amount of light in each of the steps in accordance with the following equation, to find data $D_S'$ after correction:

$$D_S'=D_S(D_{SMAX}-D_{SAV})/(D_{SMAX}-D_S1)+D_{SMAX}(D_{SAV}-D_S1)/(D_{SMAX}-D_S1)$$

wherein, $D_{SMAX}$ denotes density data corresponding to the maximum amount of light, $D_{SAV}$ denotes the average density data, and $D_S1$ denotes the selected one density data.

5. The method according to claim 1, wherein the photoreceptor has a surface which is movable relative to the density detecting device, the step of acquiring the density data outputted by the density detecting device which correspond to the amounts of light in the plurality of steps includes the step of keeping the photoreceptor in a stationary state, and the step of acquiring the density data at the plurality of points on the photoreceptor includes the steps of moving the surface of the photoreceptor relative to the density detecting device and irradiating light onto the photoreceptor which is moving from the density detecting device a plurality of times.

6. The method according to claim 5, wherein the photoreceptor is in a shape of a cylinder which is rotatable around an axis thereof, and the step of keeping the photoreceptor in the stationary state includes stopping a rotation of the photoreceptor, and the step of moving the photoreceptor includes the step of rotating the photoreceptor.

7. The method according to claim 1, wherein the density detecting device is for detecting, when a toner image corresponding to pseudo original means on which an image having a reference density is formed on the photoreceptor, a density of the toner image, and the step of setting the amount of light includes the step of setting an amount of light for detecting the density of the toner image corresponding to the pseudo original means.

8. The method according to claim 7, wherein the pseudo original means includes a white original for fog detection, the density detecting device outputs density data roughly inversely proportional to the amount of light reflected from the photoreceptor, the step of setting the amount of light includes the step of setting as an amount of light for a low-density region an amount of light in a maximum step out of amounts of light in steps in which the corrected density data have a value of not less than a predetermined value.

9. The method according to claim 8, wherein the pseudo original means further includes a black original for solid black detection, and the step of setting the amount of light further includes the step of substituting the amount of light for a low-density region into a predetermined conversion equation, thereby setting an amount of light for a high-density region.

10. An apparatus for adjusting a density detecting device in an image forming apparatus, the image forming apparatus including a photoreceptor on which an electrostatic latent image is formed, a developing device for developing the electrostatic latent image formed on the photoreceptor into a toner image, and a density detecting device for irradiating light of a predetermined amount onto the photoreceptor to output density data corresponding to the amount of reflected light from the photoreceptor, the apparatus for adjusting the density detecting device comprising:

means for successively irradiating light of amounts in a plurality of steps from a maximum amount to a minimum amount from the density detecting device onto one point of the photoreceptor on which no toner adheres, to acquire a plurality of density data outputted by the density detecting device which correspond to the amounts of light in the respective steps;

means for selecting one density data on a predetermined basis out of the plurality of acquired density data corresponding to the amounts of light in the plurality of steps;

means for irradiating light of an amount in a step corresponding to the selected one density data from the density detecting device onto a plurality of points of the photoreceptor, to acquire density data outputted by the density detecting device at the respective points;

means for finding an average value of the acquired density data corresponding to the plurality of points as average density data;

means for correcting a plurality of acquired density data corresponding to the amounts of light in the plurality of steps on the basis of the average density data and the selected one density data; and means for setting an amount of light to be irradiated onto the photoreceptor from the density detecting device when a density of a toner image formed on the photoreceptor is detected, on the basis of the plurality of density data corrected.

11. The apparatus according to claim 10, wherein the correcting means includes means for correcting the density data corresponding to the amount of light in each of the steps on the basis of the density data corresponding to the amount of light in the step, the density data corresponding to the maximum amount of light, the average density data, and the selected one density data.

12. The apparatus according to claim 10, wherein the correcting means includes means for correcting the density data corresponding to the amount of light in each of the steps on the basis of a difference between the density data corresponding to the maximum amount of light and the average density data, a difference between the density data corresponding to the maximum amount of light and the selected one density data, and a difference between the average density data and the selected one density data.

13. The apparatus according to claim 12, wherein the correcting means includes means for operating density data $D_S$ corresponding to the amount of light in each of the steps in accordance with the following equation, to set data $D_S'$ after correction:

$$D_S'=D_S(D_{SMAX}-D_{SAV})/(D_{SMAX}-D_S1)+D_{SMAX}(D_{SAV}-D_S1)/(D_{SMAX}-D_S1)$$

wherein, $D_{SMAX}$ denotes density data corresponding to the maximum amount of light, $D_{SAV}$ denotes the average density data, and $D_S1$ denotes the selected one density data.

14. The apparatus according to claim 10 wherein the photoreceptor has a surface which is movable relative to the density detecting device, the means for acquiring the density data outputted by the density detecting device which correspond to the amounts of light in the plurality of steps includes means for keeping the photoreceptor in a stationary state, and the means for acquiring the density data at the plurality of points of the photoreceptor includes means for moving the surface of the photoreceptor relative to the density detecting device, and means for irradiating light onto the photoreceptor which is moving from the density detecting device a plurality of times.

15. The apparatus according to claim 14, wherein the photoreceptor is in a shape of a cylinder which is rotatable around an axis thereof, the means for keeping the photoreceptor in the stationary state includes means for stopping a rotation of the photoreceptor, and the means for moving the photoreceptor includes means for rotating the photoreceptor.

16. The apparatus according to claim 10, wherein the density detecting device is for detecting, when a toner image corresponding to pseudo original means on which an image having a reference density is formed is formed on the photoreceptor, a density of the toner image, and the means for setting the amount of light includes means for setting an amount of light for detecting the density of the toner image corresponding to the pseudo original means.

17. The apparatus according to claim 16, wherein the pseudo original means includes a white original for fog detection, the density detecting device outputs density data roughly inversely proportional to the amount of light reflected from the photoreceptor, and the means for setting the amount of light includes means for setting as an amount of light for a low-density region an amount of light in the maximum step out of amounts of light in steps in which the corrected density data takes a value of not less than a predetermined value.

18. The apparatus according to claim 17, wherein the pseudo original means further includes a black original for solid black detection, and the means for setting the amount of light further includes means for substituting the amount of light for a low-density region into a predetermined conversion equation, thereby setting an amount of light for a high-density region.

* * * * *